United States Patent [19]

Josefowicz

[11] Patent Number: 4,547,272

[45] Date of Patent: Oct. 15, 1985

[54] METHOD AND APPARATUS FOR PRODUCTION OF A METAL FROM METALLIC OXIDE ORE USING A COMPOSITE ANODE

[75] Inventor: Jack Y. Josefowicz, Westlake Village, Calif.

[73] Assignee: Atlantic Richfield Company, Philadelphia, Pa.

[21] Appl. No.: 561,496

[22] Filed: Dec. 14, 1983

[51] Int. Cl.[4] ..... C25C 3/00; C25C 3/12; C25C 3/04; C25C 3/06

[52] U.S. Cl. ..... 204/67; 204/64 R; 204/65; 204/64 T; 204/66; 204/68; 204/69; 204/70; 204/284; 204/243 R

[58] Field of Search ..... 204/64 R, 64 T, 65–70, 204/284, 243

[56] References Cited

U.S. PATENT DOCUMENTS 4,338,177 7/1982 Withers et al. ..... 204/67
4,409,073 10/1983 Goldberger ..... 204/67

*Primary Examiner*—Howard S. Williams
*Attorney, Agent, or Firm*—Donald L. Traut

[57] ABSTRACT

An anode of a mixture of reducing agent and metal oxide particulates is inserted into an electrolytic solvent bath under compression. In forming the particulate anode, the materials of construction are selected such that there is a minimum number of particle contacts. In such a selection, the contact surface area is important and is determined primarily by particle size. The compression of the anode is maintained to deform the particles during electrolysis.

26 Claims, 2 Drawing Figures

METHOD AND APPARATUS FOR PRODUCTION OF A METAL FROM METALLIC OXIDE ORE USING A COMPOSITE ANODE

FIELD OF THE INVENTION

This invention relates to the electrolytic production of a metal from metallic oxide using a salt bath. More particularly, the invention relates to continuously producing a metallic halide using a unique anode under compression while depositing the metal at the cathode. More particularly, aluminum is deposited by electrolytic deposition from the alumina using energy-saving low electrical potentials.

BACKGROUND OF THE INVENTION

Production of a metallic product by electrolysis may be illustrated by reference to the production of aluminum. The commercial production of aluminum is typically accomplished by the Hall-Heroult process. In this process, the purified source of alumina is dissolved in a molten all-fluoride salt solvent particularly consisting of cryolite, and then reduced electrolytically with a formed carbon anode according to the reaction:

$$\tfrac{1}{2}Al_2O_3+\tfrac{3}{4}C+3e^-\rightarrow Al+\tfrac{3}{4}CO_2$$

$$\tfrac{1}{2}Al_2O_3+3/2C+3e^-\rightarrow Al+3/2CO.$$

Four characteristics of the Hall-Heroult process include: (1) carbon dioxide being produced and a carbon anode being consumed at the rate of 0.33:1 pound of carbon per pound of aluminum produced, which results in a required continual movement of the formed carbon anode downwardly toward the cathode aluminum pool at the bottom of the cell to maintain constant spacing for uniform aluminum production and thermal balance in the cell; (2) the need to feed intermittently and evenly solid alumina in a limited concentration range to the open cell to maintain peak efficiency of operation and in order to avoid the anode defects; (3) severe corrosion of the cell materials due to high temperatures of 950° to 1000° C. in the fluoride bath resulting in low cell life and increased labor; and (4) cell power efficiency is limited to less than 50% since a carbon-anode-to-liquid-aluminum distance greater than one inch must be maintained to reduce the magnetic field's undulation of the aluminum layer, which would cause intermittent shorting and result in Faradic losses due to a back reaction of aluminum droplets with carbon dioxide to produce alumina.

It is known that, in the Hall-Heroult cell reaction, the carbon of the anode contributes to the overall reaction of winning aluminum by decreasing the decomposition voltage. For example, the decomposition of $Al_2O_3$ in cryolite on a platinum anode requires about 2.2 volts, but on a carbon electrode the decomposition voltage is about 1.2 volts.

In the all-fluoride-containing bath, the alumina will dissolve in the cryolite-fluoride salt bath at a temperature of 950° to 1000° C. Bayer alumina is soluble in a cryolite-containing bath at a temperature of at least 900° C. A fluoride-containing bath having a temperature below about 900° C. will not readily solubilize ordinarily processed Bayer alumina and, therefore, the alumina, as a source of aluminum, cannot enter the reduction reaction nor is it possible for the aluminum to be deposited at the cathode.

PERTINENT ART

Pertinent art is illustrated by the process described in U.S. Pat. No. 4,338,177 ('177), in which a composite anode containing a mixture of aluminum oxide and a reducing agent effects a transformation of the aluminum oxide and produces aluminum ions in a low temperature fluoride bath. The overall reaction is believed to be essentially the same as the Hall-Heroult cell reaction as previously described. The aluminum is produced in a liquid form on a liquid metal pool serving as a cathode. The reaction occurs at the anode surface in a manner that results in the reaction of aluminum oxide similar to the mechanism that occurs in a Hall cell, even though the temperature is only slightly above the melting point of aluminum. The process uses a composite anode in a low temperature (from 670° to 810° C.) all-fluoride electrolytic bath.

In the chloride bath process disclosed in '177, aluminum chloride is produced at the anode by the reaction of the aluminous source and the reducing agent forming the anode with recycling chloride produced at the anode during electrolysis. Aluminum chloride produced at the anode upon electrolysis is ionized in the molten bath and is deposited as aluminum metal at the cathode. A porous membrane between the aluminum chloride source and the cathode passes the electrolyte and other dissolved materials while not passing undissolved impurities. In such a bath, the operating temperature is as low as 670° C. In '177, the electroresistance of the mixture of aluminum oxide and reducing agent is minimized by passing the anodic current through one or more consumable aluminum conductors of low electrical resistivity which extend into the composite aluminum oxide and reducing agent anode.

Also disclosed in '177 is a heavy salt bath which is designed to have a specific gravity greater than that of the molten metal. The heavy salt is selected from barium halide salts, particularly fluoride and chloride, and has a concentration ranging from 5 to 95%, by weight, and particularly between 30 and 60%, salt. The anode material containing metal and the reducing agent is introduced into the bottom of the cell in the form of chunks which remain at the bottom of the cell. To produce an anode material which is more dense than the otherwise heavy electrolyte, it is necessary to fabricate the anode chunks by a method using a physically compressive force such as extrusion, unless the anode material inherently has a greater bulk density than the electrolyte. Alternatively, however, if the density of the composite anode material is less than that of the heavier electrode, the anode may be retained at the cell bottom by means of an appropriate grate or membrane.

In the pertinent art of '177, consumable aluminum rods were used to provide the required conductivity in the anode. The rods were fashioned as conductive cores within the anode. It was necessary to provide aluminum rods that were sized such that they would melt approximately at the same rate as the anode material was consumed and, thus, conduct power to the bottom of the anode during the electrolysis process. If the diameter of the aluminum rod was too large, it would not melt and the salt would freeze over its end, which results in consumption of the anode while the aluminum rod would be left too short to the cathode as the anode and rods were advanced. If the rod diameter was too small, the aluminum rod would melt back too far into the anode core, resulting in a large voltage drop.

Pertinent art also includes U.S. Pat. No. 4,257,855 ('855), which discloses an electrolytic cell for the production of aluminum metal including a permanent hollow anode structure of corrosion-resistant material, with numerous perforations in the base of the structure, a packed bed of consumable carbon pieces supported by the base within the hollow space of the structure, a molten cryolite bath, means for adding fresh pieces of the consumable carbon to replenish the packed bed, and means for adjusting the depth of immersion of the packed bed within the molten cryolite bath so as to reduce voltage and energy requirements or increase the rate of aluminum production. The structure in this disclosure is the current carrying the anode and the carbon pieces are the supply of reducing material.

Pertinent art is further illustrated in International Publication No. WO87/00170, which discloses a process for the electrolytic reduction of aluminum from alumina using a carbon cathode disposed in a molten salt electrolyte solvent bath in which the alumina has been dissolved and which has a density less than the reduced molten aluminum. The steps of the process include continuously providing a particulate, free-flowing, high purity, and highly conductive carbon material to the molten bath to serve as the anode. The particulate carbon material has a density less than the molten bath. An electrical connection is placed in contact with the particulate carbon anode material and an electric current is applied. Reduced aluminum is collected at the cathode. The particulate carbon material is preferably formed from desulfurized petroleum coke which may be partially graphitized. The particulate material is required to have a lower density than the molten electrolytic bath such that it floats on the bath surface. It is also preferred that the material be relatively nonreactive with oxygen.

SUMMARY OF THE INVENTION

Therefore, in view of the above, it is an object of the present invention to provide an improved electrode apparatus for recovery of a metal from a metallic oxide ore.

It is a further object of this invention to provide an energy efficient metallurgical process for recovery of a metal from a metallic oxide ore.

The electrode apparatus of this invention is useful in an electrolytic cell for the electrodeposition of a metal from a molten electrolyte. The apparatus includes an anode containing an oxygen-containing compound of the metal in an amount sufficient to react during electrolysis and a reducing agent in contact with the metal compound and present in an amount sufficient to react with the metal compound to form the metal at the cathode, the metal compound having a particle size between about 100 and about 400 mesh, and the reducing agent having a particle size between about 5 and about 150 mesh, and means for maintaining the anode in compression at greater than atmospheric pressure during the electrolysis.

The invention also consists of a process for electrolytically depositing a metal from a molten electrolyte, including the steps of introducing particulates of an oxygen-containing compound of the metal and particulates of a reducing agent into a container immersed in the molten electrolyte, providing an electric current to the particulates of metal compound and reducing agent; and compressing the particulates to greater than atmospheric pressure—the metal compound having a particle size of between about 100 and about 400 mesh and the reducing agent having a particle size between about 5 and about 50 mesh.

BRIEF DESCRIPTION OF THE DRAWINGS

The present invention is illustrated in the accompanying drawings wherein.

DESCRIPTION OF THE PREFERRED EMBODIMENT

As used throughout the detailed description, the term "alumina" in general also covers metal oxides, and "carbon" in general also covers reducing agents.

Figure 1:
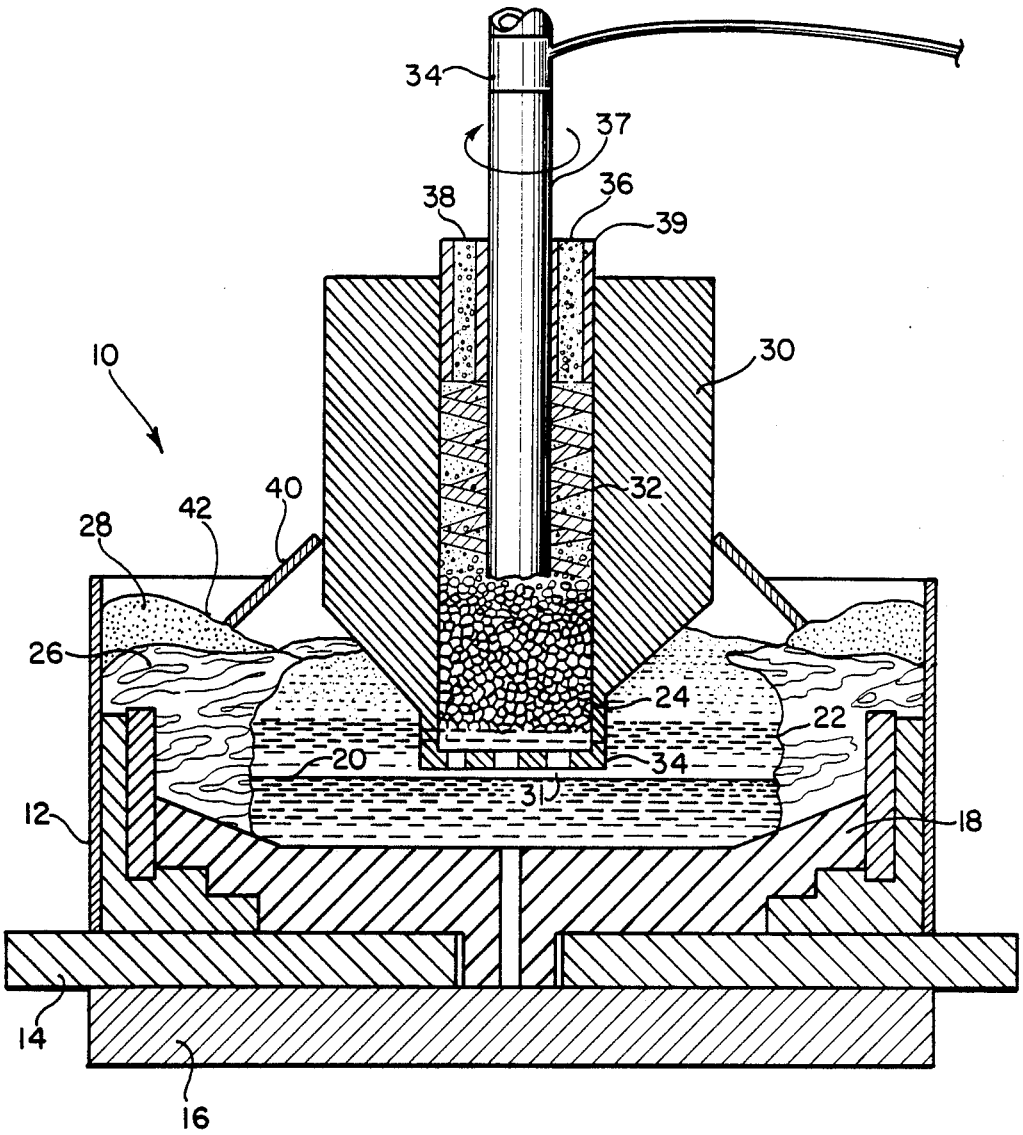
FIG. 1 is a schematic embodiment of the electrolytic cell of the present invention containing an electrode being used as an anode and having a means for maintaining the electrode in compression.

Referring to FIG. 1 of the drawings, wherein an electrolytic cell generally 10 for the electrolytic reduction of aluminum metal from an aluminous ore such as alumina or aluminum halides is shown, cell 10 includes a container 12 having a cathode collector bar 14 disposed at the bottom of the cell. The cathode collector bar 14 is insulated at the bottom surface thereof with insulation 16. Disposed oppositely from insulation 16 and on the upper surface of cathode collector bar 14 is a carbon cathode 18 which accommodates a pool of reduced molten aluminum 20 therein. Floating on top of the molten aluminum 20 is an electrolyte bath 22 and immersed in electrolyte bath 22 is a hollow structure 30 which may be either tubular or, preferably, have a square or rectangular horizontal cross-section conforming to the shape of the electrolytic cell 10. Carbon and alumina particles 24 fill most of the hollow space within hollow structure 30. Perforations 31 through the base 34 of hollow structure 30 permit the electrolyte bath 22 within the electrolytic cell 10 to submerse the lower portion of carbon and alumina particles 24 and thereby make electrolytic contact with the submersed particles.

At the periphery of electrolyte bath 22, and where the temperatures are lower, the electrolyte bath 22 is in a frozen condition and may be covered with a covering 28. Means (not shown) for supplying carbon particulate material and aluminum oxide particulate material 24 provides the materials via inlets 36 and 38. The hollow structure 30 is provided with a central rotating screw 32 therein for advancing the carbon particulate material and the aluminum oxide particulate material 24 and held within sleeve 39 is a shaft 37 which is connected to screw 32. The advancement of the carbon particulate material and the aluminum oxide particulate material 24 within hollow structure 30 compresses the particulate material to greater than atmospheric pressure.

Shaft 37 is also suitably connected to a source of electric current (not shown) at terminal 34. Also, the hollow structure 30 may be supplied with a gas collecting skirt 40 which is preferably a truncated cone in shape and is sealingly connected to the hollow structure 30. The lower peripheral edges 42 of skirt 40 are embedded in and covered by the frozen electrolyte covering 28 which is disposed over the frozen electrolyte 26.

Gases generated by particulate material 24 are trapped beneath skirt 40 for collection and venting.

Figure 2:
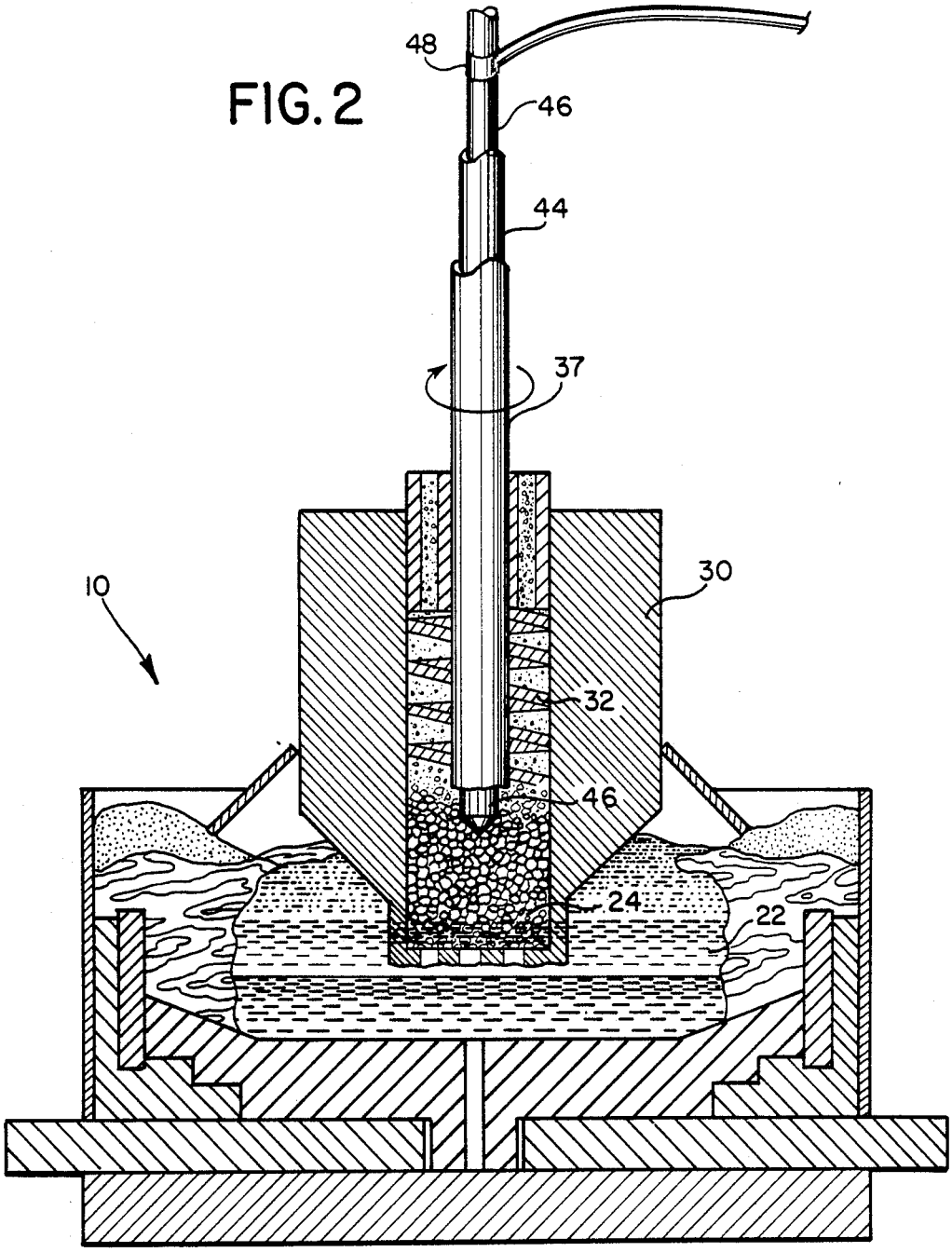
FIG. 2 is a second schematic embodiment of this electrolytic cell of the present invention containing a second means for supplying electric current to the particulate carbon material.

Alternatively, as shown in FIG. 2 of the Drawings, shaft 37 and screw 32 may be provided with a coaxial electrically insulated aperture 44 in which is situated a probe 46 for supplying electric current to the particulate material 24. The probe 46 may be stationary or rotative with the shaft 37 and screw 32. The probe 46 is connected to an electric current source (not shown) at terminal 48 and extends into particulate material 24, and preferably into the electrolyte bath 22.

Alternatively, the container 12 may be insulated and covered to engage skirt 40 or hollow structure 30 so as to eliminate the covering 28 and the frozen electrolyte 26. Preferably, this would eliminate external heating of the electrolyte bath 22 or permit increased spacing between the particulate material 24 and the cathode 18.

The reducing agent used in accordance with the present invention is not limited to any particular material, but could be any material known to be effective to react with an oxide of the metal to be recovered in the process. In the case of an aluminum chloride bath, the reaction is aluminum oxide to aluminum chloride with generation of an oxide gas. The reaction in the fluoride bath is not clearly defined and it may be that the reducing agent reacts with the aluminum oxide to produce aluminum ions.

Among the reducing agents that are particularly useful for electrolysis of alumina and other metal oxides is carbon. Carbon is particularly preferred because it has the dual capacity of carrying current to the reaction site of the aluminum oxide, as well as acting as a reducing agent. A source of carbon in the intermixture can be any organic material having a fossil origin such as coke, coal or coal products.

The method and apparatus of this invention is particularly useful on alumina, $Al_2O_3$, but it also could be any aluminum oxide-bearing material such as bauxite or a clay such as kaolin or other material which would react at the anode to produce aluminum chloride or to be reduced to molten metal, as in the fluoride cycle process.

As shown in FIG. 1, the apparatus and methods of the present invention use particulates of carbon and alumina, rather than bulk-fabricated shapes of carbon, as the anode of material. The particular carbon and alumina particles which are usable in the method of the present invention should have suitable physical characteristics to provide the needed operating requirements of the electrolysis process. More specifically, the particulates of carbon and alumina should have preselected particle size ranges. Yet further, for the purpose of conducting the improved methods of electrolysis of the present invention, the particles of carbon preferably should flow freely in the dry state. The free-flowing particulates can be introducted into the electrolytic cell as needed to maintain a steady state electro-chemical reaction condition.

The base 34 of hollow structure 30 may consist of a porous membrane for supporting the anodic material and for providing a holding means against which the anode material could be advanced into the electrolytic bath to permit compression of the anodic particulates. In the instance of the particulate materials, a screw type conveyor would be most useful to advance the material.

The characteristics of particulate material 24 to be used by the method described are extremely important to the successful performance of the electrolytic cell. The particulate material should have low electrical resistivity to minimize the internal energy losses within the current-carrying circuit. The particulate material should also have a relatively low thermal conductivity to minimize heat losses through the column of particulates and the electrode housing. Of critical importance is the particle size of particulate material 24.

In one embodiment, the carbon and alumina particulates are intermixed, particle against particle. In this embodiment, the particle sizes of the carbon should range from about 5 to about 150 mesh U.S. Standard Sieve, and the alumina particles should range from about 100 to about 400 mesh. Preferably, the carbon size range is from about 75 to about 125 mesh and the alumina from about 150 to about 350 mesh. More preferably, the carbon particle size is about 100 mesh and the alumina particle size range is between 200 to 300 mesh.

In a second embodiment, the carbon particles and alumina particles are intermixed particle within particle; that is, the alumina particles are held within or covered by the carbon particles. In this embodiment, the particle size of the carbon should range from about 5 to about 50 mesh and of the alumina from about 25 to about 200 microns. In a preferred embodiment, the carbon particle size is between about 10 to about 20 mesh. More preferably, the particle size of the carbon is about 15 mesh. Preferably, the particle size of the alumina is from about 50 to about 100 microns, and more preferably is about 75 microns.

The interlaticed carbon and alumina may be produced by a number of conventional methods, including cracking coke material in the presence of alumina particles.

The anode material—that is, the particulates—of this invention should be maintained under compression during electrolysis. Preferably, the compression forces are applied externally. The compression should be adequate to deform the carbon and alumina particles to cause increased contact area therebetween. Preferably, the compression force is at least 5 psi, and more preferably the force is at least 10 psi.

The portion of the anode which comprises metal should be maintained to cause the process to avoid the anodic effect. In an aluminum process in which the source of alumina is the anode, the ratio of reducing agent to aluminum oxide should be above 0.4:1 parts by weight. Preferably, for purposes of the present invention, the amount of aluminum oxide in the mixture should be about 0.5:1 to 0.7:1 by weight reducing agent to alumina.

In the case of aluminum as aluminous material, hydrated or calcined aluminum may be used. Anodes formed from hydrated aluminum particulates have improved conductivity compared to calcined aluminum.

The material for cathode is preferably a carbon block. To avoid electrolytic attack of hollow structure 30, its lower portion in contact with molten cryolite is preferably made of an electrically nonconductive refractory material such as boron nitride or aluminum nitride. The particulate material 24 is fed through hollow structure 30 on demand.

In the prior art, the size and surface area of the particles making up the anode have not been disclosed to have any sensitivity regarding reaction rate. It is an important aspect of this invention, however, that the size of the carbon particles and the alumina particles be controlled such that the electrical conductivity is maintained. It is another important aspect of this invention that the contact surface area of both materials be controlled for the particulates. It is generally desired to utilize aluminum with a surface area in the range of 10 to 125 meters per gram and a carbon reducing agent having a surface area of between 10 to 125 meters per gram.

In the design of the inventive anode, a conductive core of aluminum or other conductive material is unnecessary, since the particulates are selected such that they, together with the compressive means, cause the anode to be as conductive as that disclosed in '177.

It is therefore seen from the above that the present invention provides an improved process and apparatus for recovery of aluminum from aluminous ore by combined metallurgical and electrolytical techniques. It is also estimated that the capital cost for such a process is about the same or slightly less than that of the conventional Hall-Heroult process and that the process and apparatus of this invention may be economically retrofitted into the current commercial Hall-Heroult process apparatus.

It is understood that, although the present invention has been described in terms of particular materials and process steps, changes and modifications can be made in accordance with known techniques and materials by one skilled in the art within the scope of the following claims.

The invention which is claimed is:

1. An electrode apparatus useful in an electrolytic cell for electrodeposition of a metal from a molten electrolyte comprising:

a source of electric current;

a cathode for the deposition of said metal;

an anode containing an oxygen-containing compound of said metal and a reducing agent in contact with said metal compound, and present in an amount sufficient to react with said metal compound, and thereafter form said metal at said cathode; said metal compound having a particle size of between about 100 and about 400 mesh and said reducing agent having a particle size between about 5 and about 150 mesh; and a means for compressing said anode during said electrolysis to greater than atmospheric pressure.

2. The apparatus of claim 1 wherein said compressing means comprises a means for deforming said metal compound and said reducing agent.

3. The apparatus of claim 2 wherein said compressing means compresses said anode to at least about 5 psig.

4. The apparatus of claim 3 wherein said compressing means compresses said anode to at least 10 psig.

5. The apparatus of claim 1 wherein the particle size of said reducing agent ranges between about 50 and about 150 mesh and the particle size of said metal compound ranges between about 100 and about 400 mesh.

6. The apparatus of claim 5 wherein the particle size of said reducing agent ranges between about 75 and about 125 mesh and the particle size of said metal compound ranges between about 150 and about 350 mesh.

7. The apparatus of claim 6 wherein the particle size of said reducing agent is about 100 mesh and the particle size of said metal compound ranges between about 200 and about 300 mesh.

8. The apparatus of claim 1 wherein the particle size of said reducing agent ranges between about 5 and about 50 mesh and the particle size of said metal compound ranges from about 25 and about 200 microns.

9. The apparatus of claim 8 wherein the particle size of said reducing agent ranges from about 10 to about 20 mesh and the particle size of said metal compound is from about 50 microns to about 100 microns.

10. The apparatus of claim 9 wherein the particle size of said reducing agent is about 15 mesh and the particle size of said metal compound is about 75 microns.

11. The apparatus of claim 1 wherein said metal compound is selected from a group consisting of alumina, bauxite, clay and aluminum-containing oxides, and mixtures thereof.

12. The apparatus of claim 1 wherein said reducing agent comprises a carbon-containing compound.

13. The apparatus of claim 1 comprising additionally a means for containing said anode.

14. The apparatus of claim 1 wherein said metal is aluminum.

15. A process for electrolytically depositing a metal from a molten electrolyte comprising the steps of introducing particulates of an oxygen-containing compound of said metal and particulates of a reducing agent into a container immersed in said molten electrolyte, providing an electrical current to said particulates of said metal compound of and said reducing agent, and compressing said particulates to greater than atmospheric pressure—said metal compound having a particle size of between about 100 and about 400 mesh and said reducing agent having a particle size between about 5 and about 50 mesh.

16. The process of claim 15 wherein said compressing step deforms said metal compound particulates and said reducing agent particulates during the electrolysis step.

17. The process of claim 16 wherein said particulates are compressed to at least about 5 psig.

18. The process of claim 17 wherein said particulates are compressed to at least 10 psig.

19. The process of claim 15 wherein the particle size of said reducing agent ranges between about 50 and about 150 mesh and the particle size of said metal compound ranges between about 100 and about 400 mesh.

20. The process of claim 19 wherein the particle size of said reducing agent ranges between about 75 and about 125 mesh and the particle size of said metal compound ranges between about 150 and about 350 mesh.

21. The process of claim 20 wherein the particle size of said reducing agent is about 100 mesh and the particle size of said metal compound ranges between about 200 and about 300 mesh.

22. The process of claim 15 wherein the particle size of said reducing agent ranges between about 5 and about 50 mesh, and the particle size of said metal compound ranges from about 25 to about 200 microns.

23. The process of claim 22 wherein the particle size of said reducing agent ranges from about 10 to about 20 mesh, and the particle size of said metal compound is from about 50 to about 100 microns.

24. The process of claim 23 wherein the particle size of said reducing agent is about 15 mesh and the particle size of said metal compound is about 75 microns.

25. The process of claim 15 wherein said metal compound is selected from a group consisting of alumina, bauxite, clay, and other aluminum-containing oxides and mixtures thereof.

26. The process of claim 15 wherein said reducing agent comprises a carbon-containing compound.

* * * * *